US011273340B2

(12) United States Patent
Hohl et al.

(10) Patent No.: US 11,273,340 B2
(45) Date of Patent: Mar. 15, 2022

(54) SLIP TRAINING DEVICE AND RELATED METHODS

(71) Applicant: REHABILITATION INSTITUTE OF CHICAGO, Chicago, IL (US)

(72) Inventors: Kristen Hohl, Chicago, IL (US); Michael Tamkin, Chicago, IL (US); Austin Ridenour, Chicago, IL (US); James Lipsey, Oak Park, IL (US)

(73) Assignee: REHABILITATION INSTITUTE OF CHICAGO, Chicago, IL (US)

( * ) Notice: Subject to any disclaimer, the term of this patent is extended or adjusted under 35 U.S.C. 154(b) by 0 days.

(21) Appl. No.: 16/416,649

(22) Filed: May 20, 2019

(65) Prior Publication Data

US 2019/0351290 A1 Nov. 21, 2019

Related U.S. Application Data

(60) Provisional application No. 62/674,499, filed on May 21, 2018.

(51) Int. Cl.
*A63B 22/20* (2006.01)
*A63B 26/00* (2006.01)

(52) U.S. Cl.
CPC ..... *A63B 22/203* (2013.01); *A63B 26/003* (2013.01)

(58) Field of Classification Search
CPC ..... A63B 22/20–203; A63B 26/003
See application file for complete search history.

(56) References Cited

U.S. PATENT DOCUMENTS 4,229,001 A * 10/1980 Roman ..... A63B 21/012 482/114
4,506,884 A * 3/1985 Hankin ..... A63B 22/203 482/131
6,368,254 B1 * 4/2002 Wall ..... A63B 21/055 482/122
6,514,180 B1 * 2/2003 Rawls ..... A63B 21/005 482/51
6,837,838 B2 * 1/2005 List ..... A63B 21/169 482/146
7,134,987 B2 * 11/2006 Goldstein ..... A63B 21/0552 482/141
7,294,100 B2 * 11/2007 Bull ..... A63B 23/03541 482/51
7,438,673 B1 * 10/2008 Jones ..... A63B 22/203 482/51

(Continued)

*Primary Examiner* — Jennifer Robertson
(74) *Attorney, Agent, or Firm* — Polsinelli PC

(57) ABSTRACT

The present disclosure is directed to a slip training device. The training device comprises an outer frame having two ends; a plurality of platforms disposed on the outer frame, and at least one rotatable element disposed below each platform for enabling the movement of the platform with respect to the frame. Each platform is configured to be either movable along the frame or stationary with respect to the frame. In use as a slip training device, a user steps on one end of the device and walks across the device, not knowing whether a platform is moveable or stationary. If the user steps on a moveable platform, then the user will need to use balance to prevent a fall. If the user steps on a stationary platform, then the user can walk across that platform normally. Whether a particular platform is moveable or stationary can be changed each time the user traverses the device.

14 Claims, 10 Drawing Sheets

(56) References Cited

U.S. PATENT DOCUMENTS

| | | | | |
|---|---|---|---|---|
| 7,641,603 | B2 * | 1/2010 | Lacher | A63B 22/0076 482/134 |
| 7,645,218 | B2 * | 1/2010 | Potok | A63B 21/4035 482/141 |
| 7,798,943 | B1 * | 9/2010 | Tsai | A63B 21/0552 482/70 |
| 7,981,005 | B1 * | 7/2011 | Tsai | A63B 21/055 482/51 |
| 9,526,942 | B2 * | 12/2016 | Mills | A63B 21/00047 |
| 10,343,014 | B2 * | 7/2019 | Goldberg | A63B 23/03516 |
| 2003/0216230 | A1 * | 11/2003 | Wang | A63B 21/28 482/123 |
| 2005/0215401 | A1 * | 9/2005 | Wilson | A63B 23/12 482/141 |
| 2007/0117693 | A1 * | 5/2007 | Ilioi | A63B 21/4043 482/121 |
| 2009/0298655 | A1 * | 12/2009 | Lacher | A63B 23/0488 482/134 |
| 2016/0317863 | A1 * | 11/2016 | Goldberg | A63B 22/208 |
| 2016/0317870 | A1 * | 11/2016 | Haas | A63B 17/04 |
| 2017/0246498 | A1 * | 8/2017 | Forystek | A63B 23/0211 |
| 2019/0160325 | A1 * | 5/2019 | Latronica | A63B 21/4034 |
| 2019/0275367 | A1 * | 9/2019 | Goldberg | A63B 26/003 |
| 2019/0366155 | A1 * | 12/2019 | Takizawa | G05B 19/4155 |
| 2020/0001130 | A1 * | 1/2020 | Schwarz | A63B 22/203 |
| 2020/0101347 | A1 * | 4/2020 | Valdez | A63B 21/4045 |
| 2020/0108287 | A1 * | 4/2020 | Robinson | A63B 23/0205 |
| 2020/0215382 | A1 * | 7/2020 | Sankot | A63B 22/203 |
| 2020/0246653 | A1 * | 8/2020 | Merrithew | A63B 21/156 |

* cited by examiner

SLIP TRAINING DEVICE AND RELATED METHODS

RELATED APPLICATIONS

This patent claims priority to U.S. Provisional Patent Application Ser. No. 62/674,499, filed May 21, 2018, entitled "Slip Training Device and Related Methods." The entirety of U.S. Provisional Patent Application Ser. No. 62/674,499 is incorporated herein by reference.

TECHNICAL FIELD

The present disclosure is generally directed to a device and related methods for balance training.

BACKGROUND

One third of ambulatory individuals with chronic spinal cord injury will suffer at least one fall every 6 months. Furthermore, many of these falls result in serious injuries, resulting in hospitalization and increased healthcare related costs. Traditionally, it has been estimated that nearly 50% of all falls reported result from a slip occurring during walking. However, there are currently no effective interventions for reducing or preventing slips.

Current strategies to address balance deficits in individuals with spinal cord injury include dynamic and static activities. Training anticipatory balance strategies are easily achieved in the physical therapy setting, such as when someone prepares to step over an obstacle. Reactive balance strategies, or those that occur once someone has lost their balance, are harder to achieve consistently. Reactive balance responses utilized by individuals may include an ankle strategy, hip strategy or a stepping response to catch their balance to avoid a fall.

Perturbation training, which involves an externally induced force to the patient, is one tactic to elicit a reactive balance response. It is thought that with this type of trial and error training individuals can modify their response and improve their control of their center of mass within their base of support. Application of this type of perturbation training, however, is limited to external pushes at the trunk, shoulder, or upper leg. There is no currently available equipment in the physical therapy setting that creates a perturbation at the foot or slip while standardizing the perturbation parameters. Thus, it would be beneficial to have a device that could be used during physical therapy to train and strengthen patients, including the elderly or those with spinal cord injury, to reduce slip related falls.

BRIEF SUMMARY

The present disclosure is directed to a slip training device that comprises a frame, at least one platform disposed on the frame, and rotatable elements disposed below the at least platform. The frame has a first end and a second end, and a pair of lateral sides extending between the first end and the second end. The at least one platform is configured to be placed in a moveable position where the platform is moveable along the frame or a stationary position where the platform is stationary with respect to the frame. The rotatable elements allow the movement of the at least one platform along the frame.

The present disclosure is further directed a slip training device that comprises a frame, a plurality of platforms disposed on the frame, and a plurality of translational elements disposed below each platform. The frame has a first end and a second end, and a pair of lateral sides extending between the first end and the second end. Each platform is configured to be placed in a movable position where the platform is moveable along the frame or a stationary position where the platform is stationary with respect to the frame. The plurality of translational elements allows the movement of the platform along the frame.

DETAILED DESCRIPTION

Figure 1:
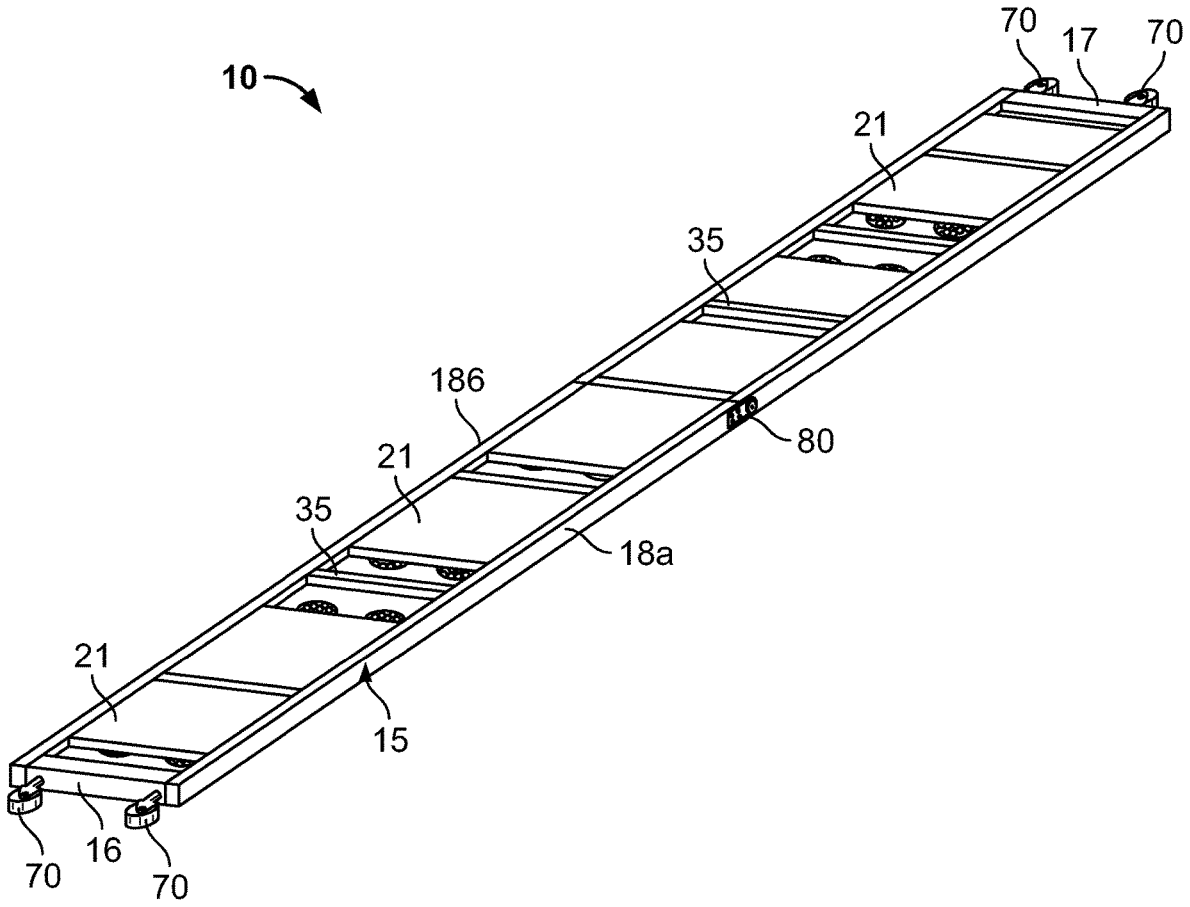
FIG. 1 displays a perspective view of a first embodiment of the device of the present disclosure.

Turning to the drawings, wherein like reference numerals refer to like elements, the present disclosure is illustrated as being implemented in a suitable environment. The following description is based on embodiments of the claims and should not be taken as limiting the claims with regard to alternative embodiments that are not explicitly described herein.

Figure 3:
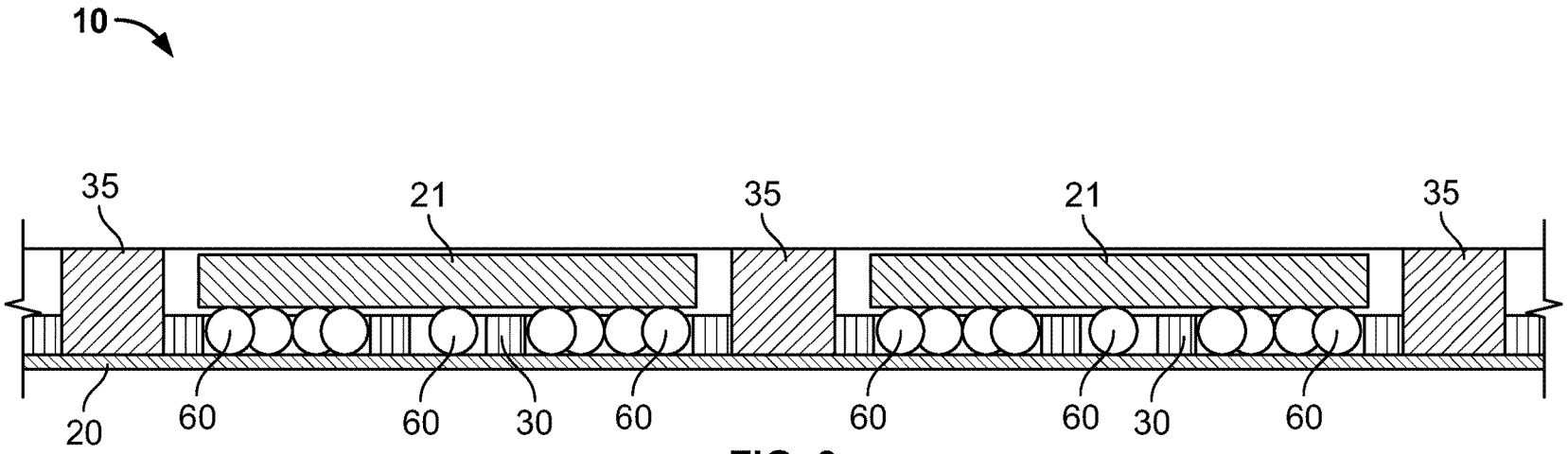
FIG. 3 displays a cross-sectional side view of the device of FIG. 1.

FIG. 1 shows device 10 comprising an outer frame 15 with a first end 16, a second end 17, an external lateral side 18*a*, an external lateral side 18*b*, and a plurality of separators 35 extending from one lateral side to the other. Device 10 may also comprise a bottom surface 20, as shown in FIG. 3. A plurality of platforms 21 is positioned within the outer frame 15 between the external sides 18*a* and 18*b*. The number of platforms may vary depending upon the embodiment of the device. Each platform 21 can be placed in two positions—a stationary position and a movable position. In the stationary position, a platform 21 is fixed with respect to the outer frame 15. In the movable position, a platform 21 is moveable longitudinally along the lengths of lateral sides 18*a* and 18*b*. Each platform 21 may move longitudinally when perturbed by a force, such as a force from a patient attempting to walk on the platform 21. Each platform 21 may be separated from the adjacent platforms by separators 35. The separator 35 stops the platform 21 from further longitudinal movement when the platform 21 abuts a face of the separator 35. Thus, the movement of an individual platform can be limited by the separators 35 adjacent to it.

The device 10 may be folded into two segments using a hasp 80. In such an embodiment, each lateral side 18 consists of two members, thereby allowing the device to be folded. Further, wheels 70 on each end of the device may be provided to allow the device 10 to be rolled into use or storage. The device 10 may be comprised of wood, plastic, or other suitable materials.

Figure 2:
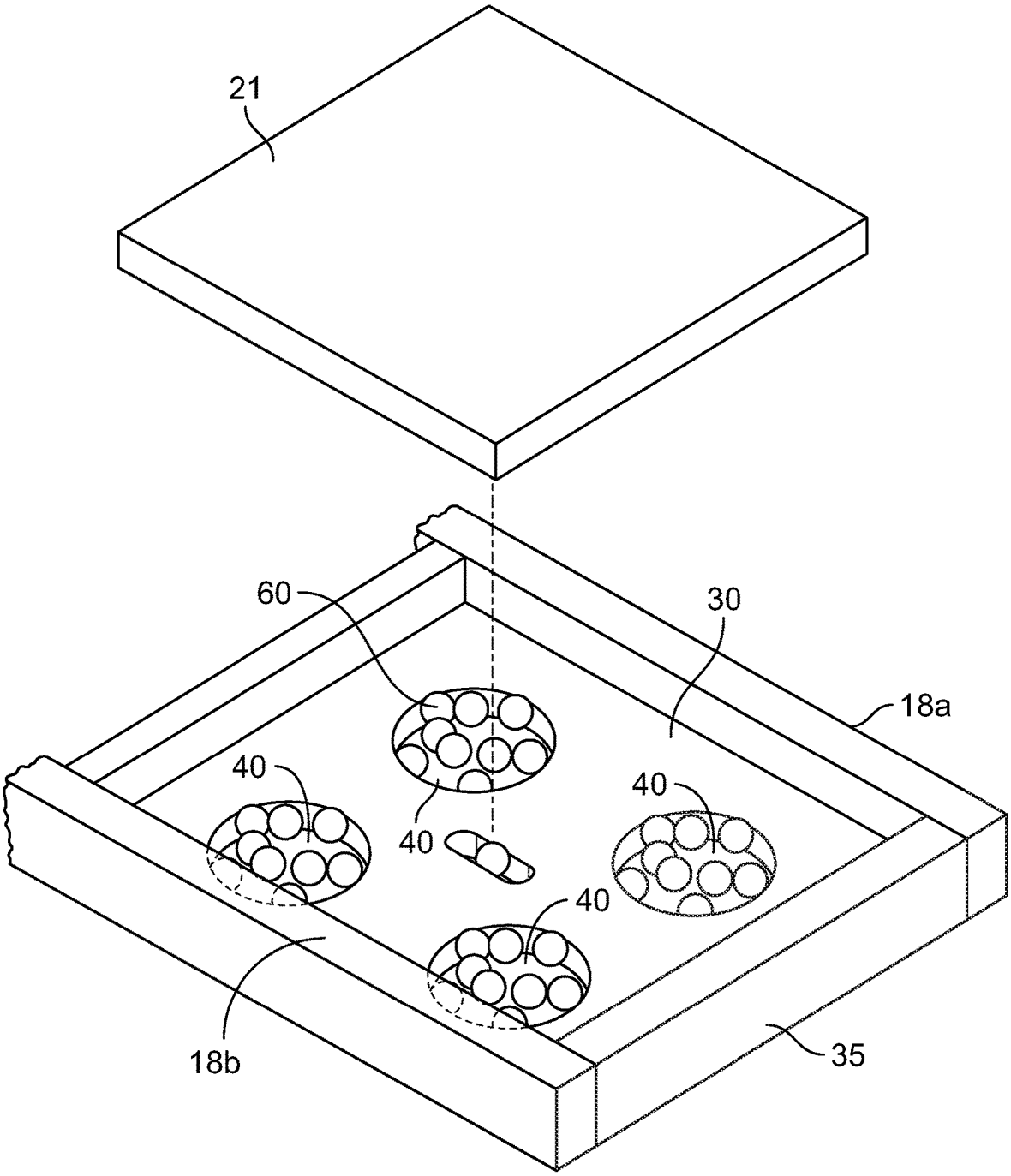
FIG. 2 displays an exploded view of a section of an interior of the device shown in FIG. 1.

FIG. 2 shows an exploded view of a section of an interior of the device 10. A substrate 30 may be positioned between the platform 21 and the bottom surface 20 (shown in FIG. 3). The substrate 30 may be comprised of cardboard, plastic, or other suitable materials. The substrate 30 has one or more openings 40. Each opening 40 may be positioned at least partially below a platform 21. As shown in FIG. 2, the openings 40 are circular. Other shapes may be used instead, including but not limited to rectangles or ovals. An opening 40 may span the length of several platforms 21.

Each opening 40 may contain one or more rotatable elements 60. The rotatable elements 60 shown in FIG. 2 are spherical, but other shapes may be used. Each opening 40 may also contain an opening filler to limit the space available for the movement of the rotatable elements 60 within the opening 40. Using an opening filler can reduce the movement of the rotatable elements 60 within the opening 40, which can slow the longitudinal movement of the platform 21 positioned above the opening 40. A suitable material for the opening filler is cardboard; however, it should be understood that the filler could be any solid material that could fill the opening.

Figure 4:
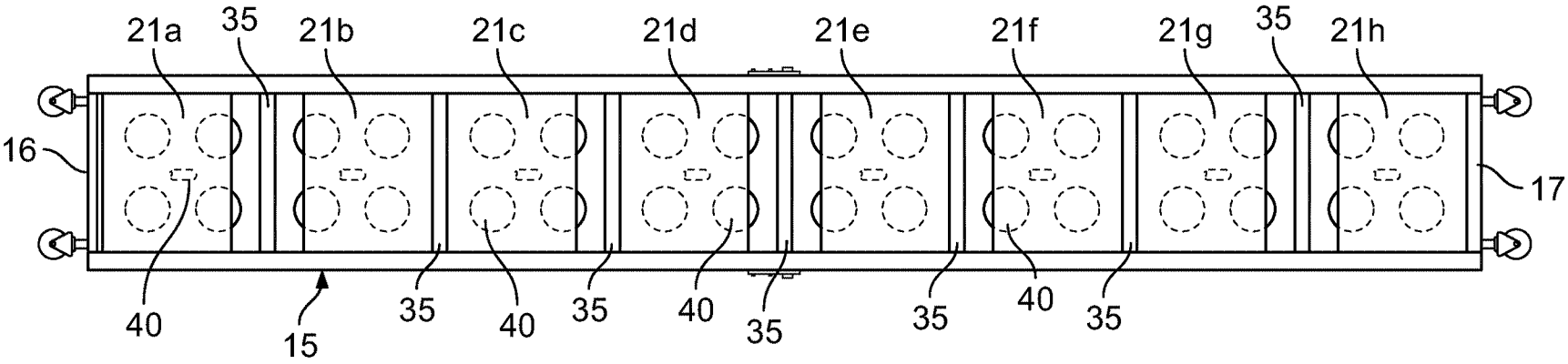
FIG. 4 displays a top view of the device of FIG. 1.

FIG. 3 shows a cross-sectional view of the device 10 along line 3-3 of FIG. 4, indicating the relative position of the platforms 21, separators 35, substrate 30, rotatable elements 60, and bottom surface 20. As shown in FIG. 3, the height of each rotatable element 60 is slightly greater than the height of the substrate 30, allowing the platform 21 to rest on the top surface of the rotatable elements 60 while the bottom surface of the rotatable elements 60 touch the bottom surface 20. This allows the rotatable elements 60 to contact the bottom surface of the platform 21, allowing the platform 21 to roll along the rotatable elements 60 as the platform 21 moves back and forth along the length of the device 10.

FIG. 4 displays a top view of the device 10. The platforms 21*a*-21*h* are positioned between the first end 16 and second end 17, with each platform separated from the adjacent platform by a separator 35. Each opening 40 is positioned at least partially below one of the platforms 21-21*h* so that the rotatable elements 60 contained in the opening 40 contact the platform 21*a*-21*h*.

In an embodiment, the device 10 may have a length of 1.7 m and a width of 0.43 m. Each platform 21 may be movable towards and away from each of the first end 16 and the second end 17 of the outer frame 15. In an embodiment, a platform 21 may have a length of 11.75 inches. Each platform may have a width of 0.42 m. The platforms may be located between separators 35, allowing about 0.1 m of movement longitudinally of the platform 21. The present disclosure, however, is not limited to the dimensions provided above and may vary in other embodiments. Within the substrate 30, there may be openings 40 spaced such that all openings 40 are at least partially underneath a platform 21 when the device is assembled. In one embodiment, there are four circular openings 40 cut into the substrate 30, all located directly beneath a platform 21 in the assembled device such that they are completely hidden from a user's sight. The rotatable elements 60 may take various forms. For instance, a rotatable element 60 may be a 19 mm metal ball bearing.

When using the device 10, a user places his or her foot on the platform 21*a* positioned adjacent to the first end 16, and begins to walk toward the second end 17 on top of successive platforms 21*b*-21*h*. Some of the platforms 21*a*-21*h* may not have rotatable elements 60 positioned in the substrate openings 40 below the platform. Other platforms 21*a*-21*h* may have rotatable elements 60 positioned in the substrate openings 40 below the platform. When the user steps on such a movable platform, the force from the user's gait moves the platform backwards towards the first end 16. This movement creates an unpredictable perturbation that replicates the movement of the user slipping on a slippery surface, such as ice. The therapist may identify in advance which platforms are not fixed to the device 10, or the therapist may allow the user to discover which platforms are not fixed while the user is walking along the platforms 21. When a user places his or her weight on a movable platform 21, the platform rolls along the rotatable elements 60 positioned below the platform 21. This can require the user to engage the muscles responsible for upright balance.

Figure 5:
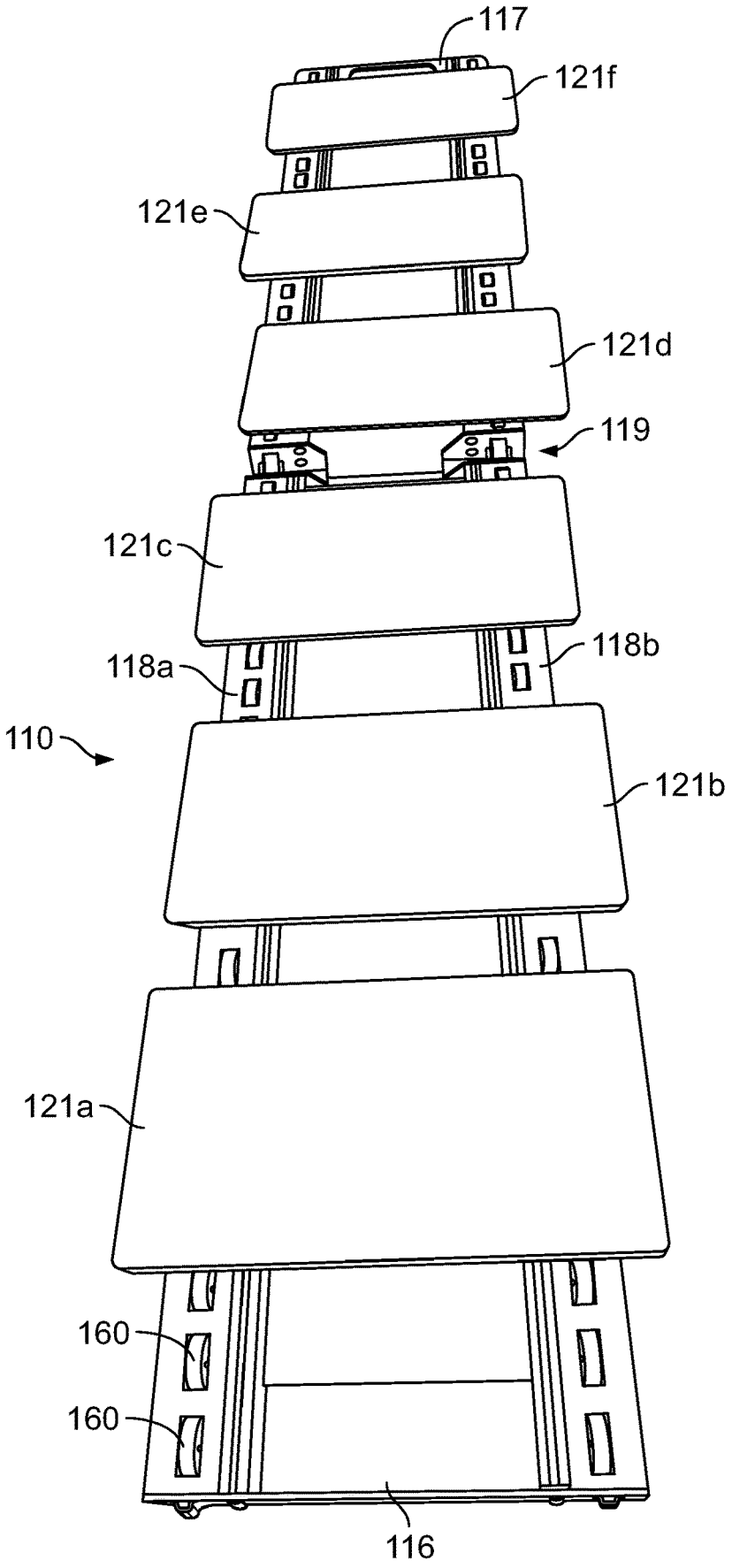
FIG. 5 displays a top perspective view of a second embodiment of the device of the present disclosure.

FIG. 5 shows a second embodiment of a slip training device, in the form of device 110. The device 110 comprises an outer frame 115 with a first end 116, a second end 117, a first lateral side 118*a*, a second lateral side 118*b*, and a bottom surface 124 (shown in FIG. 8). Each lateral side 118*a* and 118*b* has a plurality of rotatable elements 160 positioned therein. One or more platforms 121 may be positioned to rest on the top surfaces of each of the rotatable elements 160. Each rotatable element 160 is positioned within an opening 140 (shown in FIG. 7). The device 110 may be separated into multiple sections for ease in setup and storage, or may be foldable with the use of a hasp 119, as is the case with the device 10. Wheels may be provided on the end of each section of the device 110 to make transporting the device 110 easier.

Figure 6:
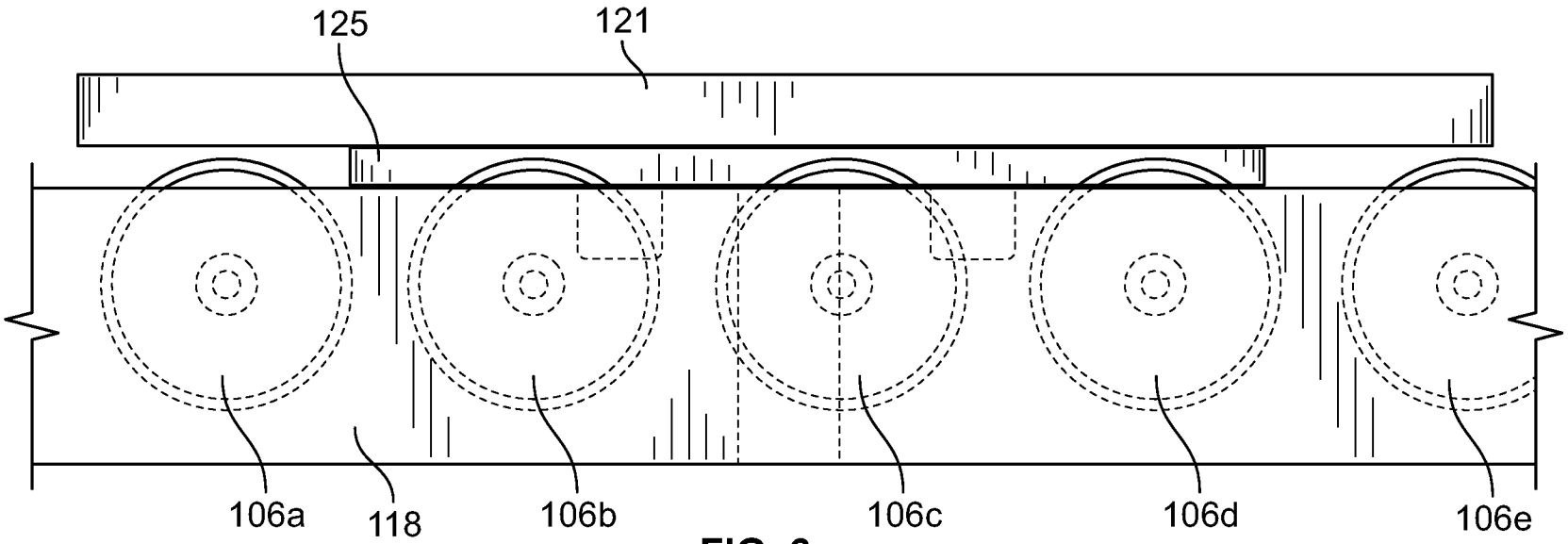
FIG. 6 displays a side view of a section of the device of FIG. 5.

FIG. 6 shows a side view of a section of the device 110. As shown in FIG. 6, the top surface of each rotatable element 160 extends slightly above the top of the lateral side 118*a* or 118*b* so that the platform 121 can move along the top surfaces of each rotatable element 160. (As shown in FIG. 6, the platform 121 is positioned slightly above the top surfaces of each rotatable element 160. In use, however, the bottom surface of the platform 121 may rest on the top surface of each rotatable element 160.)

Figure 7:
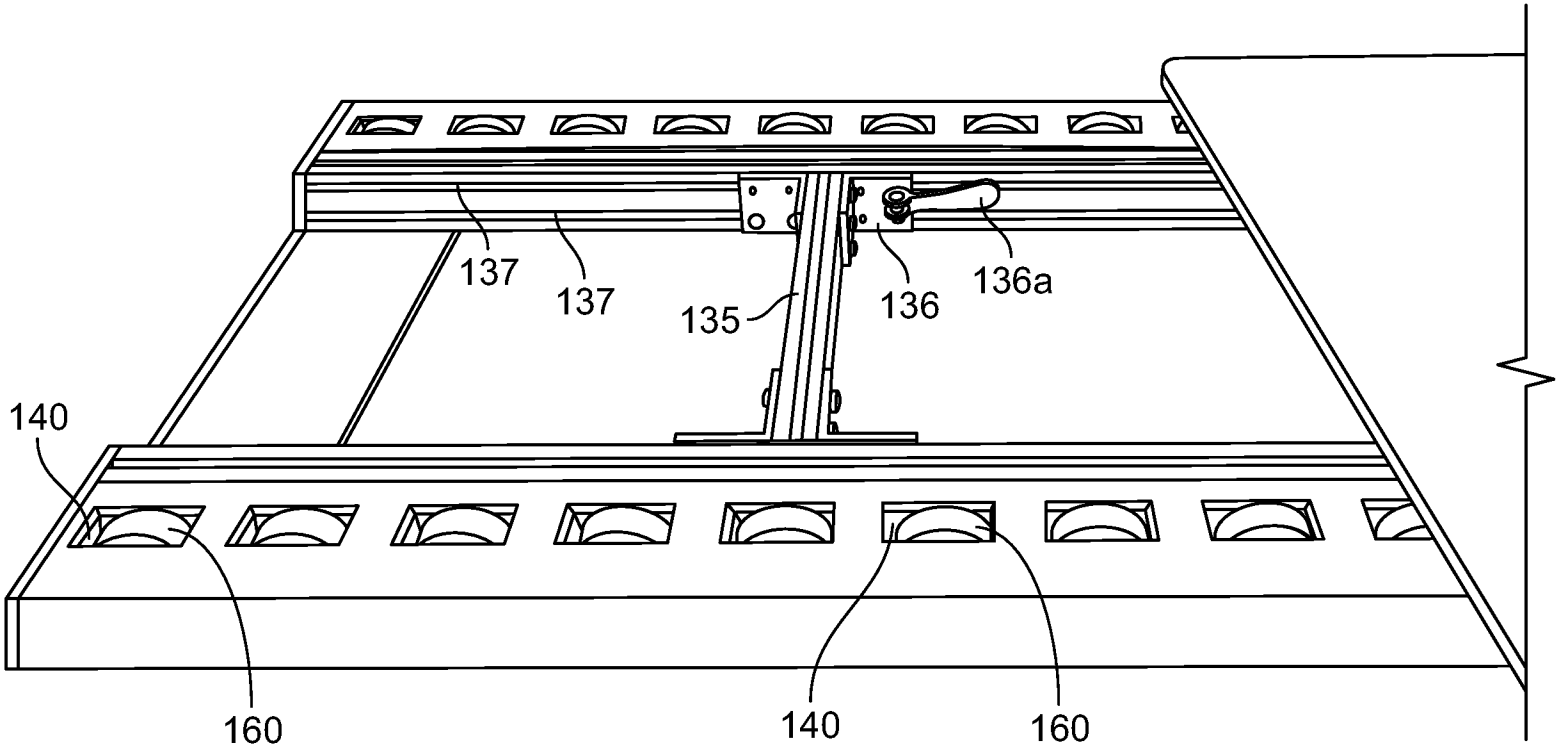
FIG. 7 displays a perspective view of a portion of the device of FIG. 5.

FIG. 7 shows a perspective view of a portion of the device 110. As shown in FIG. 7, a separator 135 may be positioned between the first lateral side 118*a* and the second lateral side 118*b*. The position of the separator may be adjusted along the length of the device 110. For instance, as shown in FIG. 7, the interior surface of each lateral side is provided with a track 137. The separator 135 may be attached to tracks 137. When the separator 135 is unlocked from the tracks 137, the separator may be slidably repositioned along the length of the device 110. The separator 135 may be locked into place at each end by a lock mechanism 136 comprising a lock handle 136*a*. Although a single lock mechanism 136 is shown in FIG. 7, a lock mechanism may be provided for each end of the separator 135. Any suitable lock mechanism can be used to lock the separator 135 in place along the tracks 137.

Figure 8:
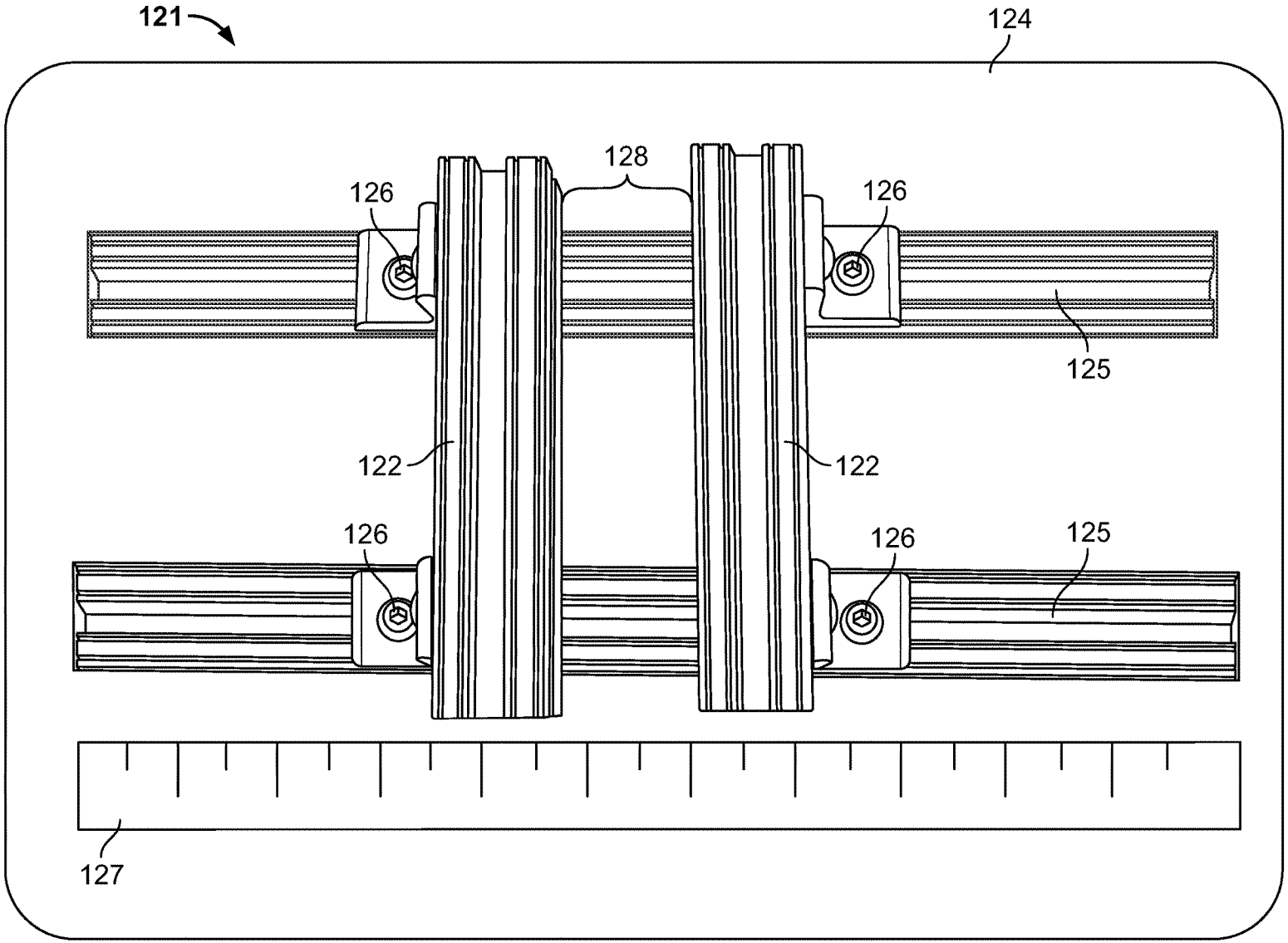
FIG. 8 displays a bottom view of a platform of the device of FIG. 5.
Figure 9:
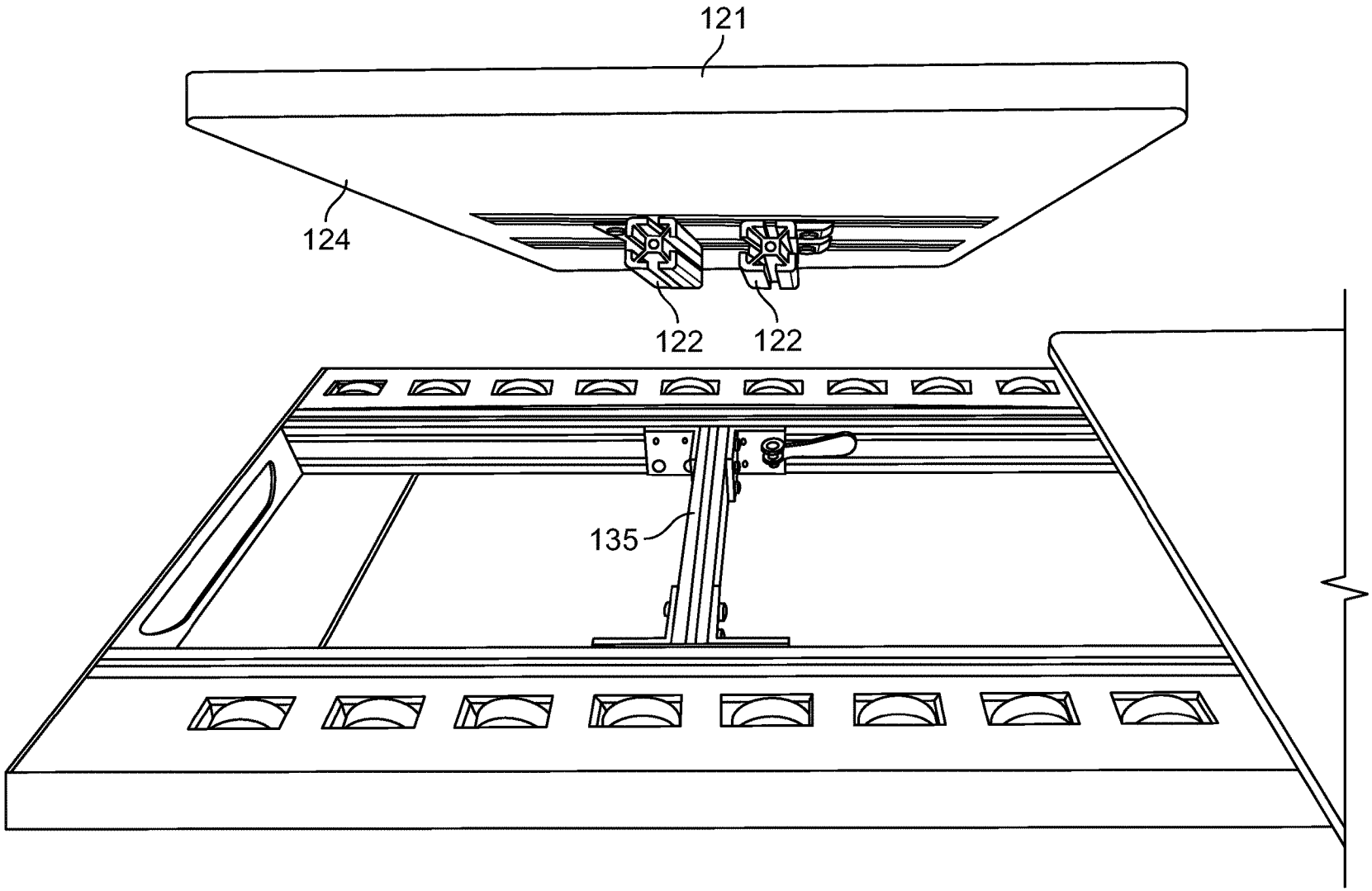
FIG. 9 displays an exploded view of the device of FIG. 5.

FIG. 8 shows a view of the bottom surface 124 of an exemplary platform 121. A pair of tracks 125 may be affixed to the bottom surface 124 and a pair of stoppers 122 may be provided on the tracks 125. The position of the stoppers 122 may be adjusted along the length of the tracks 125 to increase or decrease the space 128 between the stoppers 122. Stoppers may be mounted to the tracks 125 with suitable fasteners such as, for example, bolts 126. The distance between the stoppers 122 may be adjusted as desired by the therapist and/or the user. When the platform 121 is placed back upon the device 110, as shown in FIG. 9, the separator 135 fits within the space 128 between the stoppers 122. If there is a narrow space between the stoppers 122, the platform 121 will have relatively little movement along the length of the device 110. If there is a greater space between the stoppers 122, the platform 121 will have relatively greater movement along the length of the device 110. If the distance between the stoppers 122 is equal to the width of the separator 135, there is no movement and the platform remains stationary. The bottom surface 124 further includes a ruler 127 that can be used to measure the distance the stoppers are moved each time they are adjusted.

The device 110 is used to train in the same manner as device 10. When using the device 110, a user places his or her foot on the platform 121*a* positioned adjacent to the first end 116, and begins to walk toward the second end 117 on top of successive platforms 121*b-f*. Although FIG. 5 depicts six platforms, it should be understood that additional or fewer platforms may be provided along the device 110. Some of the platforms may be locked and thus remain stationary when a user steps thereon while other platforms may be unlocked and thus movable. When the user steps on such a movable platform, the force from the user's gait causes the platform 121 to move along the top surfaces of the rotatable elements 160. This movement creates an unpredictable perturbation that replicates the movement of the user slipping on a slippery surface, such as ice. The extent of the movement of each platform 121 along the length of the device 110 is determined by the distance between the stoppers 122.

Figure 10:
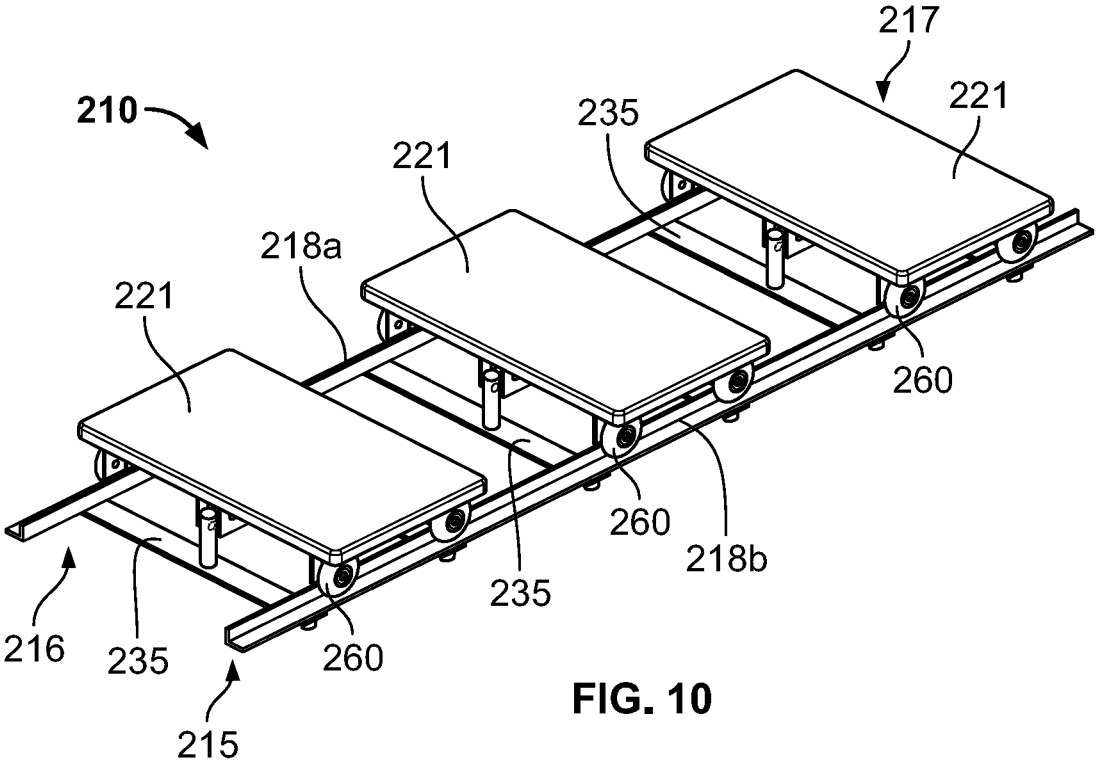
FIG. 10 displays a perspective view of a third embodiment of the device of the present disclosure.

FIG. 10 displays a perspective view of a third exemplary device 210. The device 210 comprises an outer frame 215 with a first end 216, a second end 217, an external lateral side 218*a*, an external lateral side 218*b*, one or more platforms 221 positioned between the lateral sides, and a number of separators 235 extending between the lateral sides and rigidly connecting the lateral side 218*a* with the lateral side 218*b*. Similar to the other embodiments discussed above, each platform 221 can be placed in a stationary position or a movable position. In the stationary position, a platform 221 is fixed with respect to the outer frame 215 as will be discussed in further detail below. In the movable position, a platform 221 is moveable along the lateral sides 218*a* and 218*b*.

In the embodiment of FIG. 10, the lateral sides 218*a*, 218*b* take the form of a track with an L-shaped cross-section, but could take alternate shapes in other embodiments. Each platform 221 is provided with wheels 260 mounted along opposite lateral sides of the bottom of each platform 221. The wheels 260 roll along the track of lateral sides 218*a* and 218*b*. It should be understood that while three platforms 221 are shown in FIG. 10, more or fewer platforms could be provided for use with the device 210.

Figure 11:
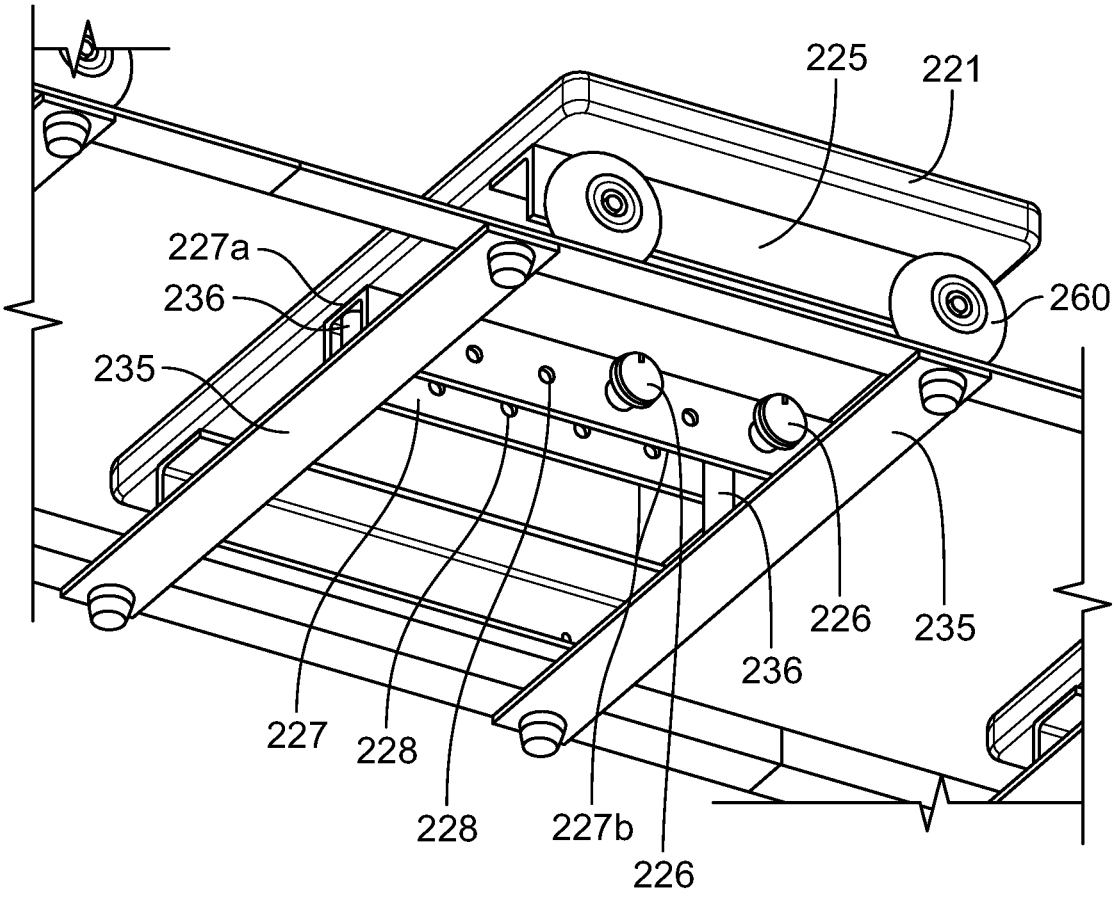
FIG. 11 displays a bottom perspective view of the device of FIG. 10.

FIG. 11 displays a bottom perspective view of the device 210. Each side of the platform 221 is provided with a connector rail 225. Each connector rail 225 mounts wheels 260 to the lower surface of the platform 221. The wheels 260 are rotatably mounted to the rail 225.

The bottom surface of platform 221 is further provided with a brace member 227. The member 227 may take the form of a bracket with a U-shaped cross-section mounted to the bottom surface of the platform, the bracket having a base 227*a* and two legs 227*b* extending therefrom. However, in alternate embodiments, the brace may take another form such as a pair of legs mounted directly to the bottom surface of the platform 221. The legs 227*b* may have a plurality of pairs of holes or openings 228 through which pins 226 may be inserted. The device 210 further may have a vertical separator 236 with a bottom end that is rigidly affixed to a separator 235 and a top end that extends upwardly therefrom. To limit the amount of movement of the platform, the top end of the vertical separator 236 is inserted between the legs 227*b* of the bracing member 227 and pins 226 are inserted transversely through a respective pair of holes 228 in the legs 227*b*. The height of the vertical separator 236 is low enough to allow the bottom surface of the platform 221 to pass over it, but high enough to collide with the pins 226 when the user moves the platform 221 along the length of the device 210. Thus, the vertical separator 236 limits the amount the platform 221 can move along the lateral sides 218*a*, 218*b* by colliding against the pins 226. To allow the platform 221 to move a greater amount, the distance between the openings 228 into which the pins 226 are inserted is increased. Conversely, to decrease the movement of the platform 221, the pins 226 are inserted into adjacent pairs of openings 228. If the pins 226 are positioned immediately adjacent to the vertical separator 236, the separator 236 is trapped and the platform 221 is not allowed to move and remains stationary.

Figure 12:
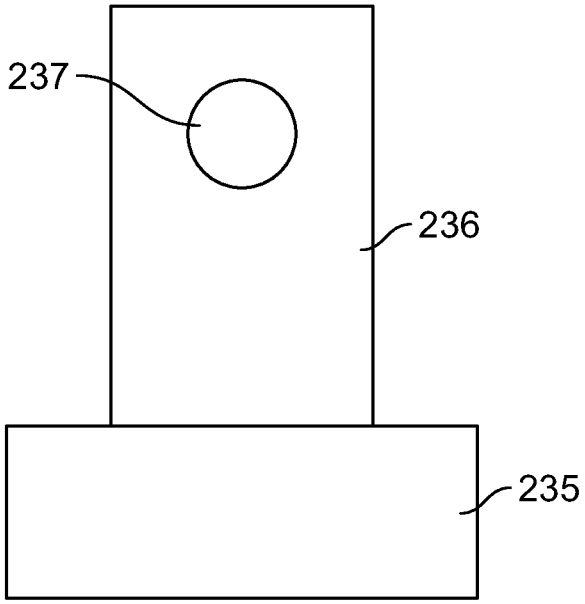
FIG. 12 displays a side view of a vertical separator used in the device of FIG. 10.

FIG. 12 shows a side view of an embodiment of a vertical separator 236. The vertical separator 236 may have an opening or hole 237 through which a pin 226 may be placed. When the pin 226 is inserted through the opening 237 and the openings 228 in the brace 227, the platform 221 is rigidly fixed with respect to the device 210 and is prevented from moving along the frame. This can be referred to a locked position. This aspect may be useful for locking the platform 221 during therapy or for transporting the device 210.

When using the device 210, a user places his or her foot on the platform 221*a* positioned adjacent to the first end 216, and begins to walk toward the second end 217 on top of successive platforms 221*a-c*. Although FIG. 10 depicts only three platforms, it should be understood that additional platforms may be provided along the device 210. Some of the platforms may be in a stationary or locked position, and thus remain stationary when a user steps thereon. Other platforms may be in a movable position. When the user steps on such a movable platform, the force from the user's gait causes the wheels 260 to roll along the tracks of the lateral sides 218*a*, 218*b* and move the platform backwards towards the first end 216 or forward towards the second end 217. This movement creates an unpredictable perturbation that replicates the movement of the user slipping on a slippery surface, such as ice. Of course, it is possible that the user causes the platform 221 to move back and forth along the tracks, in an attempt to regain balance. The movement of the platform 221 is limited or restricted by the distance between the pins 226 on the brace 227 and thus the corresponding distance that platform 221 may travel in either direction before motion is impeded by contact between vertical separator 236 and the respective pin 226.

The therapist may identify in advance which platforms are not fixed to the device 210, or the therapist may allow the user to discover which platforms are not fixed while the user is walking along the platforms 221. If the user steps on a stationary platform, then the user can walk across that platform normally. When a user places his or her weight on a movable platform 221, this may require the user to engage the muscles responsible for upright balance to prevent a fall. Whether a particular platform is moveable or stationary can be changed each time the user traverses the device. By repeatedly traversing the device, each time with potentially different moveable platforms, individuals can be trained to modify their response, exercise the muscles responsible for upright balance, and improve their control of their center of mass within their base of support. Having better control of their center of mass helps to reduce slip related falls.

In the various embodiments described above, the rotatable elements take the form of wheels. However, it should be understood that any translational mechanism can be used that enables movement of the platforms along the frame. Examples of translational mechanisms include rollers, casters, linear guides, and linear rails.

What is claimed is:

1. A slip training device, comprising:

a. a frame having a first end and a second end, and a pair of lateral sides extending between the first end and the second end, and at least one separator extending between the lateral sides of the frame;

b. at least one platform disposed on the frame and configured to be placed in a moveable position where the platform is moveable along the frame or a stationary position where the platform is stationary with respect to the frame, the at least one platform comprises a plurality of platforms, each platform having two lateral sides, the at least one separator being positioned below the at least one platform;

c. rotatable elements disposed below the at least platform for allowing the movement of the at least one platform along the frame; and d. the at least one separator is provided with a vertical separator extending upwardly from the separator and configured to lock the at least one platform, wherein the at least one platform has a bottom surface provided with a brace and a pair of pins, the pins configured to cooperate with the vertical separator to place the at least one platform in the stationary position.

2. The device of claim 1 wherein the separator limits the movement of the platform along the frame.

3. The device of claim 1, wherein an opening is defined at one end of the vertical separator and one of the pins is capable of being inserted through the opening to place the platform in a locked position.

4. The device of claim 1, wherein the brace further comprises two legs separated by a distance and one end of the vertical separator is configured to be inserted between the two legs.

5. The device of claim 4 wherein the brace further provided with pairs of corresponding openings on the legs, each pin configured to be inserted through a pair of openings.

6. The device of claim 5 wherein the pins can be inserted into any of the pairs of corresponding openings on the legs of the brace, the distance between the pins on the brace determining the amount of movement along the frame that the vertical separator and thus the platform can experience.

7. The device of claim 1 wherein the rotatable elements are provided adjacent each lateral side of a platform.

8. The device of claim 7 wherein each platform is provided with a connector rail along each lateral side of the platform, the rotatable elements rotatably mounted on each connector rail.

9. The device of claim 8 wherein each lateral side of the frame comprises a track, the rotatable elements configured to rotate along each track to move the platform on the frame.

10. The device of claim 8 wherein the rotatable elements comprise wheels.

11. A slip training device, comprising:

a. a frame having a first end and a second end, and a pair of lateral sides extending between the first end and the second end;

b. a plurality of platforms disposed on the frame, each platform configured to be placed in a movable position where the platform is moveable along the frame or a stationary position where the platform is stationary with respect to the frame;

c. a plurality of translational elements disposed below each platform for allowing the movement of the platform along the frame;

d. the frame further comprises a plurality of separators extending between the lateral sides and positioned below the platforms; and e. each separator is provided with a vertical separator extending upwardly therefrom and configured to be positioned underneath one of the plurality of platforms wherein each platform has a bottom surface, the bottom surface provided with a brace and a pair of pins, the pair of pins configured to cooperate with the vertical separator of a platform to place that platform in the stationary position.

12. The device of claim 11 wherein each platform having two lateral sides and provided with a connector rail along each lateral side of the platform, the translational elements operatively mounted on each connector rail.

13. The device of claim 12 wherein each lateral side of the frame comprises a track, the translational elements configured to translate along each track to move the platform on the frame.

14. The device of claim 11, wherein one end of the vertical separator is provided with an opening, each pin configured to be inserted through the opening to place the platform in a locked position.

* * * * *